US007204395B2

(12) United States Patent
Gallagher

(10) Patent No.: US 7,204,395 B2
(45) Date of Patent: Apr. 17, 2007

(54) CANTED UNIVERSAL ELASTIC POLYMER HOLSTER HANGER WITH INDISTINGUISHABLE BELT LOCK AND FLEX ARM TO CONCEAL HOLSTER, TO PRODUCE SHIRT-ENGAGING FLEX CAM SURFACE, AND TO PRODUCE FLEXED GUN SECURING SURFACE

(76) Inventor: Richard N. Gallagher, 2019 W. Quail Rd., Phoenix, AZ (US) 85027

( * ) Notice: Subject to any disclaimer, the term of this patent is extended or adjusted under 35 U.S.C. 154(b) by 83 days.

(21) Appl. No.: 11/096,275

(22) Filed: Mar. 31, 2005

(65) Prior Publication Data

US 2006/0219743 A1 Oct. 5, 2006

(51) Int. Cl.
*F41C 33/00* (2006.01)

(52) U.S. Cl. ..... 224/192; 224/198; 224/272; 224/912; 224/911; 224/666; 224/667

(58) Field of Classification Search ..... 224/193, 224/666, 668, 676, 911, 667; D3/222
See application file for complete search history.

(56) References Cited

U.S. PATENT DOCUMENTS 2,410,640 A * 11/1946 Engle ..... 224/198
2,917,214 A * 12/1959 Resnick ..... 224/198
2,987,230 A * 6/1961 Taylor ..... 224/197
3,664,560 A * 5/1972 Perkins ..... 224/677
3,952,930 A * 4/1976 Baldocchi ..... 224/193
4,504,001 A * 3/1985 Nichols ..... 224/198
5,067,642 A * 11/1991 Fodge ..... 224/192
5,167,355 A * 12/1992 Hill ..... 224/193
5,641,102 A * 6/1997 Hellweg ..... 224/198
6,010,045 A * 1/2000 Rogers et al. ..... 224/198
6,092,703 A * 7/2000 Johnson ..... 224/198
6,588,639 B2 * 7/2003 Beletsky et al. ..... 224/672
6,685,067 B2 * 2/2004 French ..... 224/198
6,763,984 B2 * 7/2004 Gallagher ..... 224/193

* cited by examiner

*Primary Examiner*—Tri M. Mai
(74) *Attorney, Agent, or Firm*—Tod R. Nissle, P.C.

(57) ABSTRACT

A method and apparatus for flexing a concealed holster to secure the contents of the holster in the holster. An elongate substantially rigid elastically flexible sling is secured to a side of the holster such that the elongate member and side of the holster can be partially separated so the wearer's shirts can be inserted therebetween to conceal the holster. The lower end of the sling can be flexed outwardly away from the side of the holster such that a portion of the outer side adjacent the lower end is, when the sling is flexed outwardly to insert the wearer's shirt, flexed inwardly to compress a pistol in the storage compartment.

1 Claim, 6 Drawing Sheets

FIG. 1
(PRIOR ART)
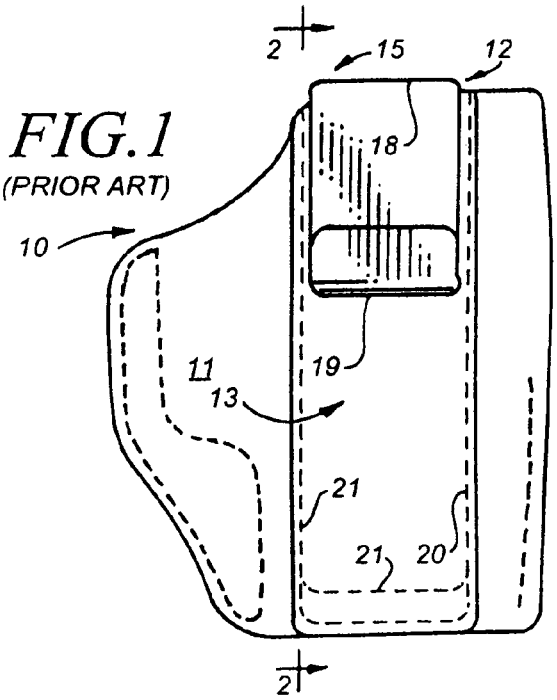
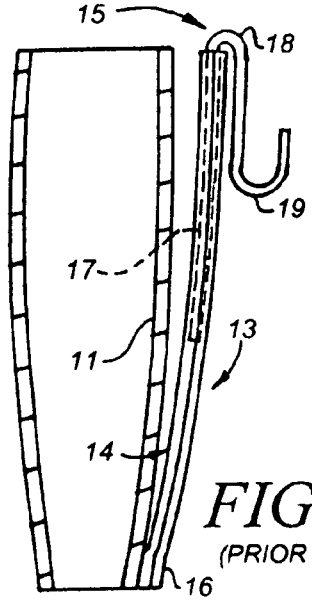
FIG. 2
(PRIOR ART)
FIG. 3
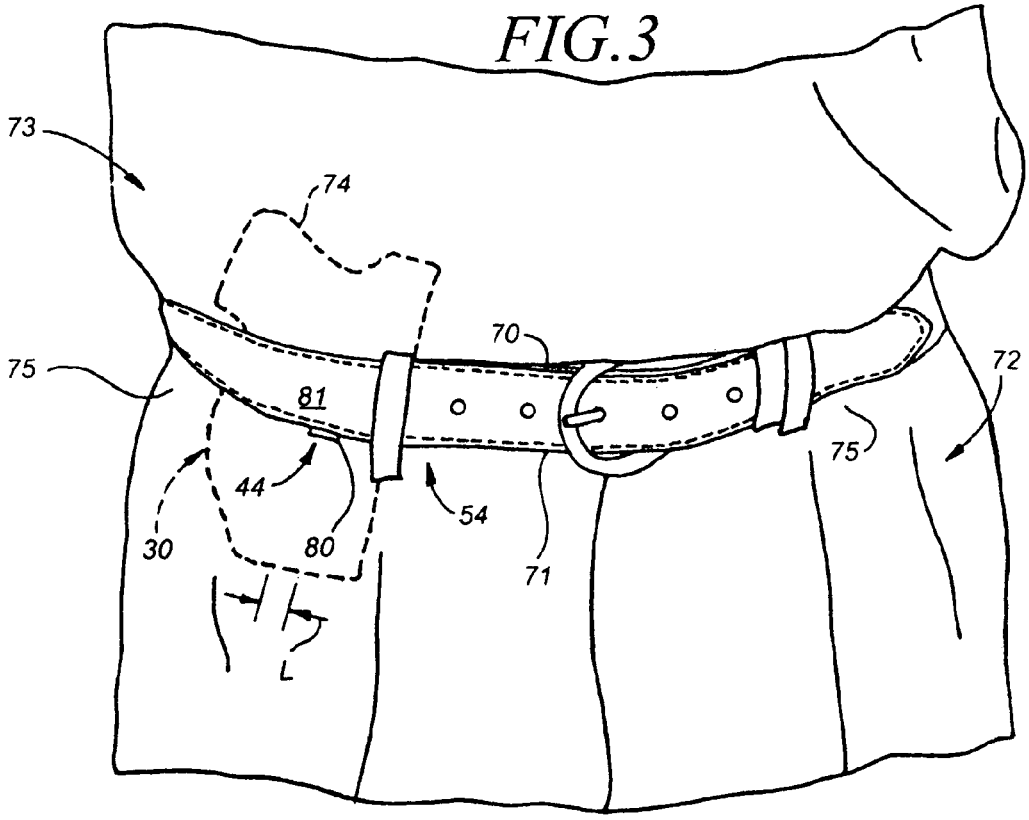

FIG. 4
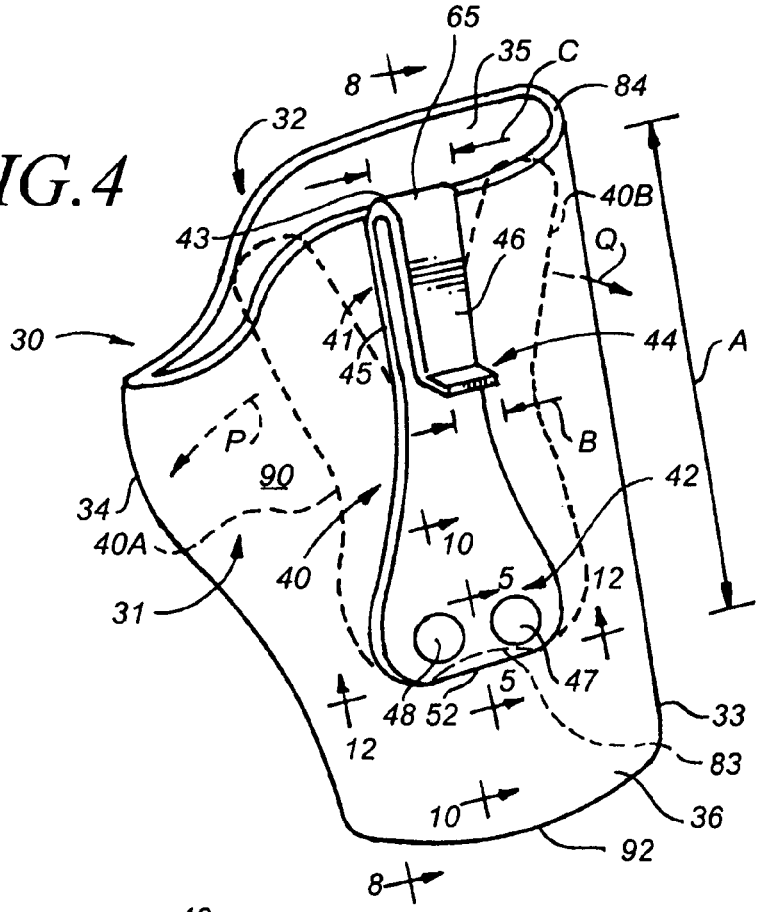
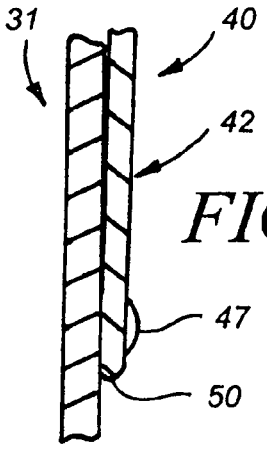
FIG. 5
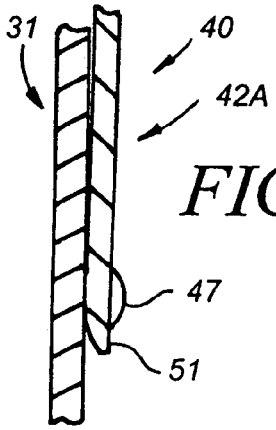
FIG. 6
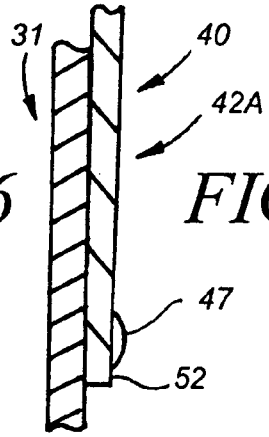
FIG. 7

FIG.8
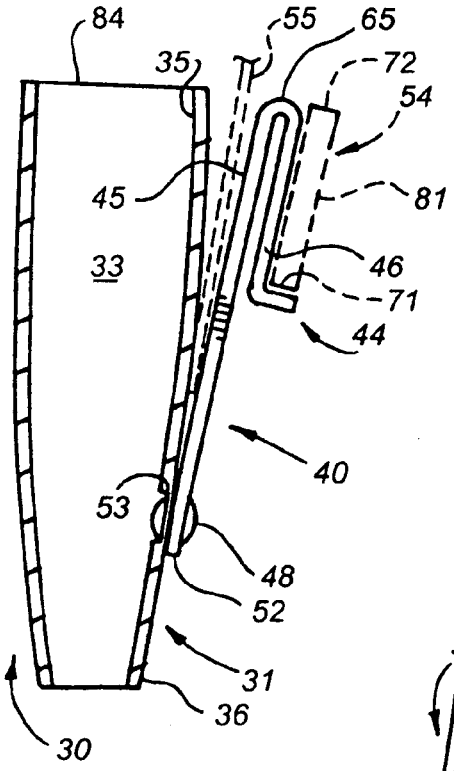
FIG.9
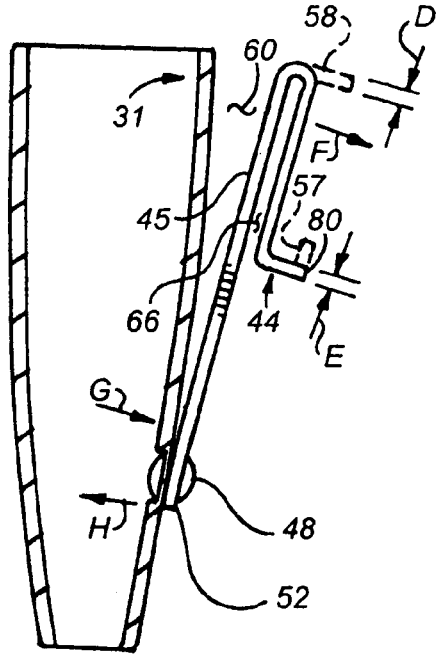
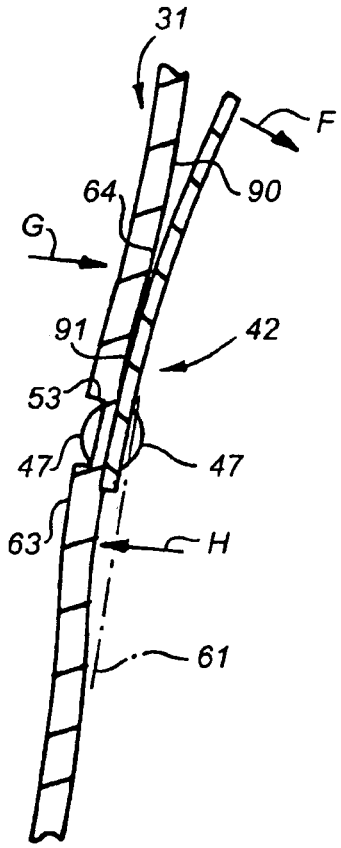
FIG.10

FIG.11
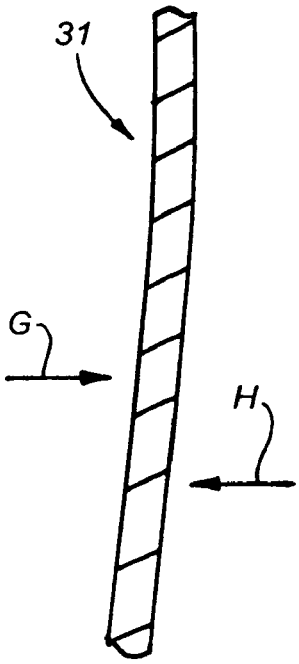
FIG.12
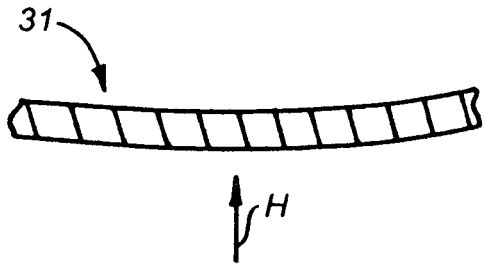
FIG.12A
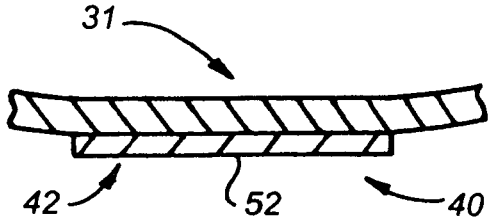
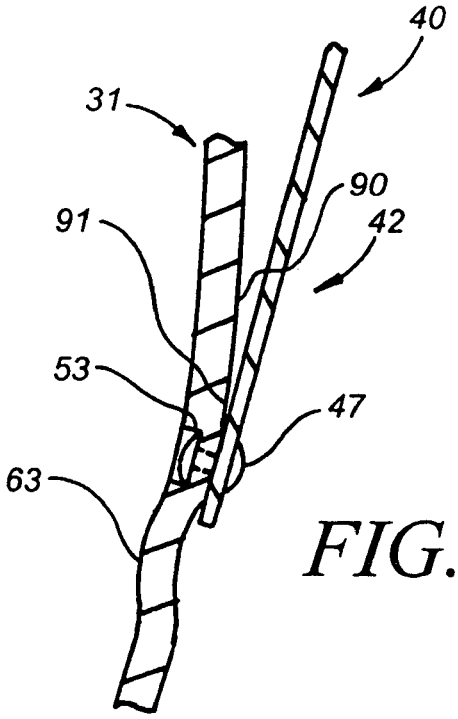
FIG.11A

FIG. 14
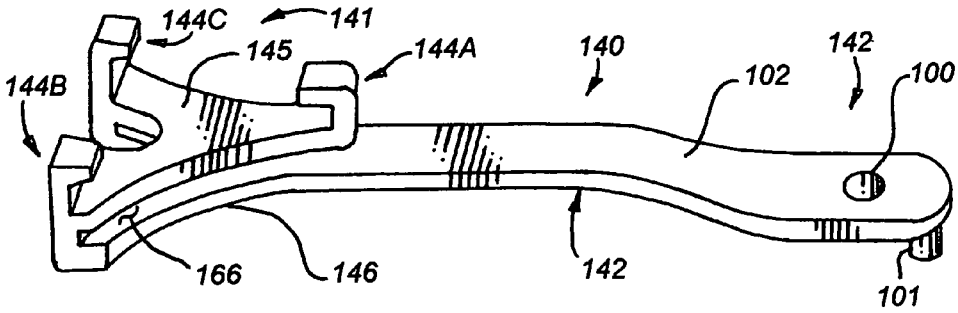
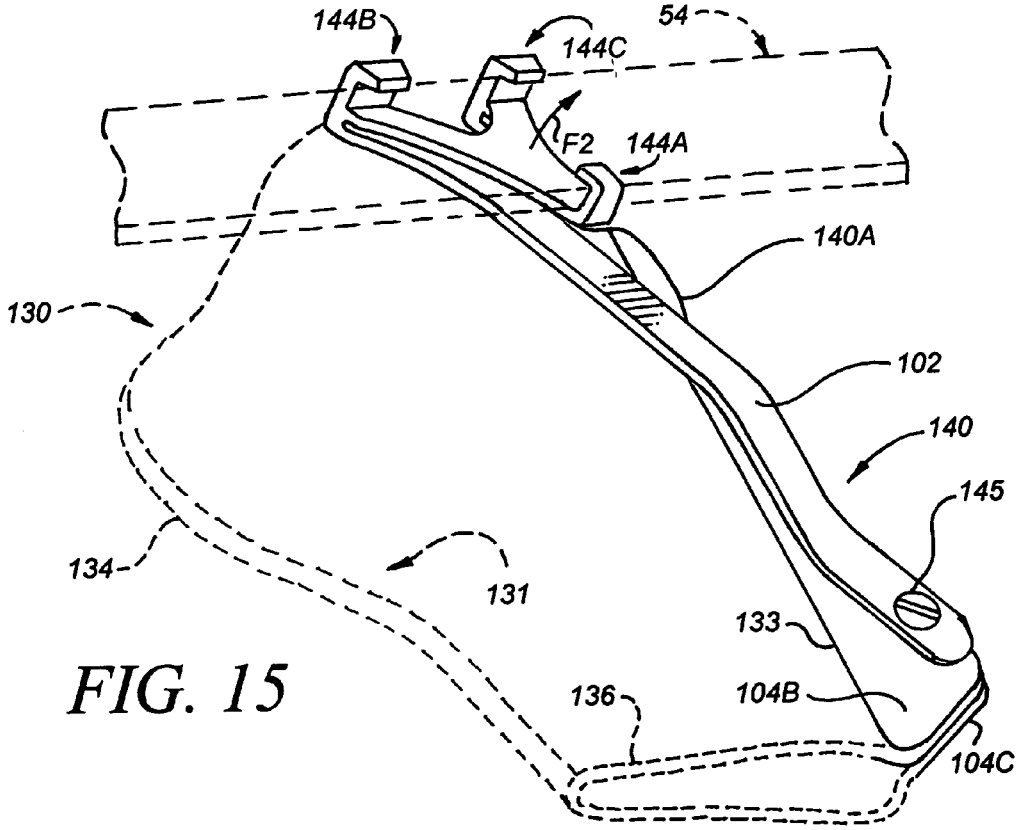
FIG. 15

CANTED UNIVERSAL ELASTIC POLYMER HOLSTER HANGER WITH INDISTINGUISHABLE BELT LOCK AND FLEX ARM TO CONCEAL HOLSTER, TO PRODUCE SHIRT-ENGAGING FLEX CAM SURFACE, AND TO PRODUCE FLEXED GUN SECURING SURFACE

This invention relate to holsters.

More particularly, the invention relates to a method and apparatus for concealing a holster.

In a further respect, the invention relates to a method and apparatus for flexing a concealed holster to secure the contents of the holster in the holster.

In another respect, the invention relates to a method and apparatus for providing a concealed holster with a belt lock having a size, shape, color, or position that renders the belt lock indistinguishable to a casual observer.

In still a further respect, the invention relates to a method and apparatus for providing a universal waistband hanger that can be attached to any size handgun holster without requiring that the waistband hanger be redesigned for each different sized holster or that different sized holsters be redesigned to accommodate the waistband hanger.

In still another respect, the invention relates to a method and apparatus for providing a waistband hanger that can be attached to a holster to flex the holster to produce a cam surface that engages a user's shirt intermediate the holster and the waistband hanger.

Various concealed holsters are known in the art.

U.S. Pat. No. 6,089,432 discloses a holster having a lower portion that is inserted beneath the waistband of a user's trousers. The upper portion of the holster extends above the waistband and is visible.

U.S. Pat. No. 5,865,357 discloses a belt clip that can be used to support a holster inserted beneath the waistband of a user's trousers.

U.S. Pat. No. 4,235,356 describes a pouch in which a firearm is carried. The pouch is attached to the shirttail of a user so the pouch is completely concealed beneath the waistband of the user's trousers.

U.S. Pat. No. 4,785,983 discloses a holster that can be worn under the arm as part of a shoulder harness, that can be worn on a user's belt, or that can be supported on the belt and substantially concealed inside the waistband of a user's trousers. The holster includes fastening loops 26, 52, 56 that circumscribe the user's belt.

U.S. Pat. No. 6,092,702 describes a holster that is concealed inside the waistband of a user. The holster can include loops 22*a*, 22*b*, 80 or slots 72 or sleeves 74 that secure the holster to a belt.

U.S. Pat. No. 5,570,827 describes a holster that is mounted inside the waistband of a user's trousers and includes a clip 44. A pager unit is mounted in clip 44 to disguise the holster.

U.S. Pat. No. 6,264,079 describes a holster that can be concealed inside the waistband, on the belt or waistband, inside a boot, or inside a jacket pocket. The holster includes a clip 16. VELCO™ fastener is used to detachably secure the clip 16 to the holster at different positions.

U.S. Pat. No. 5,419,472 describes a holster mounted on a user's belt. The holster includes a loop 16 that circumscribes a user's belt.

The invention described herein pertains more specifically to a concealed holster that is worn inside a user's waistband and that permits a user's shirt to be inserted intermediate the holster and the waistband. U.S. Pat. No. 4,022,361 discloses a holster of this general type.

The holster in U.S. Pat. No. 4,022,361 to Devlin is—like the holster in the above-noted U.S. Pat. No. 6,264,079-covered with a layer 21 of VELCRO fastener. A support sling 14 includes VELCRO on its inner surface such that sling 14 can be removably attached to the VELCRO 21. Sling 14 is preferably formed with a metal insert 24 stitched between opposite layers of leather 22 and 26 so that sling 14 is rigid. The upper end 16 of sling 14 is positioned immediately adjacent and along the outer side of the holster. The tail 58 of the user's shirt is, as shown in FIG. 3 of the Devlin patent, positioned intermediate the outer side of the holster and the upper end 16 of sling 14. Devlin indicates that the pressure exerted by the body of the wearer secures the wearer's shirt in position between the upper end 16 of sling 14 and the outer side of the holster. The pressure exerted by a user's body may secure the wearer's shirt because a portion of VELCRO 21 contacts the shirt, or because the inner surface of upper end 16 and the outer surface of the holster are rough or tacky. When however, the user's shirt does not contact VELCRO fastener 21 and the inner surface of upper end 16 or outer surface of the holster is smooth, it appears that the users shirt can fairly easily slide in and out between end 16 and the holster unless the pressure exerted by the user's body is extreme. One reason the user's shirt is able to move between end 16 and the holster is believed to be the fairly large surface area of end 16 adjacent the holster and contacting the user's shirt. Another reason is believed to be that the construction of sling 14 produces a fairly uniform pressure along the vertical height of end 16. The use of VELCRO fastener 21 is not preferred because pulling a shirt free tends to accelerate wear of the shirt. Similarly, the VECRO 21 not covered by sling 14 tends to contact and wear the user's pants, especially when the pants are made from fabrics that readily secure to VELCRO. Another disadvantage of the holster and sling 14 in the Devlin patent is that the sling and VELCRO layer 21 must generally be redesigned for different sizes of holsters. For example, a VELCRO layer 21 that fits one size holster may not fit another size holster. A sling 14 that fits one size holster may not fit another size holster. Another disadvantage of the sling 14 is that each time end 16 is bent away from the holster, the VELCRO on end 16 tends to separate from the VELCRO layer 21. A further disadvantage of the Devlin holster is that it requires a layer 55 of VELCRO fastener on the back of the user's belt.

Another prior art concealed holster system that I earlier developed is illustrated in FIGS. 1 and 2 herein. This concealed holster system has been sold for a number of years internationally by Galco International, Inc. under the trademark "STEALTH". This concealed holster system includes a holster 10 and a sling 13 attached to the bottom of a side 11 of the holster. The sling includes a pair 13, 14 of equivalent rectangular leather straps stitched together 20, 21, 22 around their perimeter to receive the leg 17 of a substantially rigid polymer component 15. This laminate construction of leather-polymer-leather is similar to the laminate leather-metal-leather construction described above in the Devlin holster and performs the same function of increasing the rigidity of sling 13. Component 15 includes an upper end 18 bent over on itself and includes a belt-engaging hook 19.

One disadvantage of the concealed holster system depicted in FIGS. 1 and 2 herein is that the tail of a user's shirt can fairly readily slide intermediate side 11 and inner strap 14, even when pressure from the user's body forces side 11 against strap 14. Consequently, the tail of the user's shirt can "ride" up and out from between strap 14 and side 11. One reason the user's shirt is able to move between end 16 and the holster is believed to be the fairly large surface area of inner strap 14 adjacent the holster and contacting the user's shirt. Another reason is believed to be that the construction of sling 13 produces a fairly uniform compressive pressure along the vertical height of strap 14 and between strap 14 and side 11.

Another disadvantage of the concealed holster system of FIGS. 1 and 2 is that it must generally be redesigned for different sizes of holsters. Leather straps 13, 14 that fit one holster are too long or too short for another holster. A VELCRO layer 21 that fits one size holster may not fit another size holster. Having to redesign the structure of sling 15 for different sized holsters significantly increases the cost of manufacturing the concealed holster system.

A further disadvantage of the holster system of FIGS. 1 and 2 is that it utilizes leather. Over time the rigidity of the leather breaks down when the leather is repeatedly flexed or bent toward and away from the holster. The leather is also susceptible to damage from perspiration and other moisture.

Still another disadvantage of the concealed holster system of FIGS. 1 and 2 is that the system utilizes two different kinds of material in constructing the sling, and requires that the two materials be secured together, which significantly increases manufacturing costs Still a further disadvantage of the concealed holster system of FIGS. 1 and 2 is that the hook 19 is about an inch wide and produces a large enough visible signature that an individual casually greeting the user may see the hook 19 and realize the user is wearing a concealed weapon.

Yet another disadvantage of the concealed holster system of FIGS. 1 and 2, as well as of the holster described in the Devlin patent discussed above, is that it requires a significant quantity of leather to produce. Leather is expensive.

Yet a further disadvantage of the concelaed holster system of FIGS. 1 and 2, as well as of the holster described in the Devlin patent discussed above, is that it requires a two-step stitching operation, including stitching to produce the sling 13 and stitching to attach a component of the system to the holster.

Yet still another disadvantage of the concealed holster system of FIGS. 1 and 2 is that when the sling 13 is in the normal operative position shown in FIG. 2, the user's shirt sleeve readily moves between sling 13 and the side 11 of the holster 10.

Yet still a further disadvantage of the concealed holster system of FIGS. 1 and 2 is that when the holster system is positioned in the waistband of a user and sling 13 tends to be forced against side 11 by the user's body, elastic forces are generated that act to return the sling 13 to the sling 13 to the normal operative position shown in FIG. 2.

Accordingly, it would be highly desirable to provide an improved concealed holster system that would more securely maintain a user's shirt intermediate the sling and holster, that would not require redesign of the sling for different sized holsters, that would not require the use of leather, that would not require multiple stitching operations in construction a sling and mounting it on a holster, that would produce a visual signature unlikely to be noticed by the casual observer, that would secure a user's shirt intermediate the holster and holster sling when the sling is in its normal relaxed operative position, and that would not generate forces opposing the compressive forces maintaining a user's shirts intermediate the sling and holster.

Therefore, it is a principal object of the invention to provide an improved holster system.

Another object of the invention is to provide an improved concealed holster system that includes a sling and that securely maintain a user's shirt intermediate the sling and holster both when the sling is in its normal operative position and when the sling is compressed against a side of the holster.

A further object of the invention is to provide an improved concealed holster system including a sling that does not require redesign for different sized holsters.

Still another object of the invention is to provide an improved concealed holster system that would not require the use of leather or require multiple stitching operations in constructing a sling and mounting it on a holster.

Still a further object of the invention is to provide an improved concealed holster system using a sling that is visually indistinguishable to a casual observer.

Yet another object of the invention is to provide an improved concealed holster system that secures a user's shirt intermediate the holster and holster sling when the sling is in its normal relaxed operative position.

Yet a further object of the invention is to provide an improved concealed holster system that does not generate forces opposing the compressive forces maintaining a user's shirts intermediate the sling and holster.

These and other, further and more specific objects and advantages of the invention will be apparent to those of skill in the art from the following detailed description thereof, taken in conjunction with the drawings, in which:

FIG. 1 is a side view illustrating a prior art concealed holster system,

FIG. 2 is a side section view illustrating further construction details of the holster system of FIG. 1 and taken along section line 2—2 thereof;

FIG. 3 is a front view illustrating a concealed holster system constructed in accordance with the invention and mounted inside the pants waistband of a user;

FIG. 4 is a perspective view illustrating the concealed holster system of the invention;

FIG. 5 is a side section view of a portion of the holster system illustrating construction details thereof and taken along section line 5—5 thereof;

FIG. 6 is a side section view illustrating an alternate embodiment of the structure illustrated in FIG. 5;

FIG. 7 is a side section view illustrating another alternate embodiment of the structure illustrated in FIG. 5;

FIG. 8 is a side section view of the holster system of FIG. 4 illustrating additional construction details thereof and taken along section line 8—8 thereof;

FIG. 9 is a side section view of the holster system of FIG. 4 illustrating the mode of operation thereof;

FIG. 10 is an enlarged view of a portion of the side section view of FIG. 9 further illustrating the mode of operation thereof;

FIG. 11 is a section view of a portion of a side of the holster of FIG. 4 taken along section line 11—11 thereof;

FIG. 11A is a section view of the side of the holster of FIG. 11 illustrating the deformation of the side after the sling is attached thereto;

FIG. 12 is a section view of a portion of a side of the holster of FIG. 4 taken along section line 12—12 thereof;

FIG. 12A is a section view of the side of the holster of FIG. 12A further illustrating the deformation of the side after the sling is attached thereto;

Figure 13:
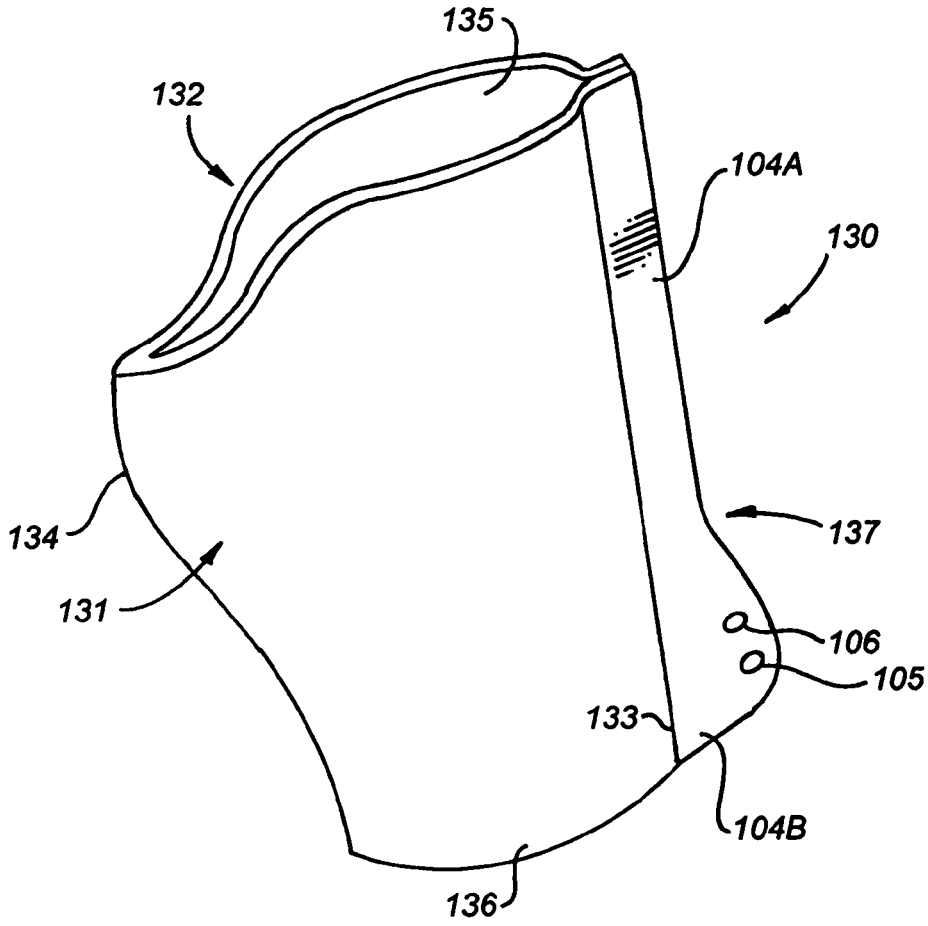

FIG. 13. Is a perspective illustrating a holster utilized in an alternate embodiment of the invention;

FIG. 14 is a perspective view illustrating a flexible sling or hanger constructed in accordance with an alternate embodiment of the invention; and, FIG. 15 is a perspective view illustrating the mode of operation of the sling of FIG. 14.

Briefly, in accordance with the invention, I provide an improved holster system for concealment inside the trouser waistband of a wearer and suspended from the trouser waistband of the wearer at the inner side of the belt, the belt including an upper edge and a lower edge. The holster system includes a holster case defining a pistol storage compartment. The holster case includes an inner side; an outer elastically flexible side having a top and a bottom; a front; and, a back. An elongate substantially rigid elastically flexible sling is secured to the outer side whereby the elongate member and the outer side of the holster case can be partially separated so the wearer's shirt can be inserted therebetween to conceal the holster. The sling includes an upper end reversibly bent to form a mounting tab shaped to extend over the trouser waistband, and includes a tab shaped to extend over one of the edges of the belt. The tab includes an end. The sling also includes a lower end connected to the outer side intermediate the bottom and the top of the outer side such that when the sling is flexed outwardly away from the outer side, the wearer's shirt can be inserted therebetween to conceal the holster case; and, a portion of the outer side adjacent the lower end is, when the sling is flexed outwardly to insert the wearer's shirt, flexed inwardly to compress a pistol in the storage compartment.

In another embodiment of the invention, I provide an improved holster system for concealment inside the trouser waistband of a wearer and suspended from the trouser waistband of the wearer at the inner side of the belt, the belt including an upper edge and a lower edge. The holster system includes a holster case defining a pistol storage compartment. The holster case includes an inner side; an outer elastically flexible side having a top and a bottom; a front; and, a back. The holster system also includes an elongate substantially rigid elastically flexible sling secured to the outer side whereby the elongate member and the outer side of the holster case can be partially separated so the wearer's shirt can be inserted therebetween to conceal the holster. The sling includes an upper end and a lower end. The upper end is reversibly bent to form a mounting tab shaped to extend over the trouser waistband behind the belt, and includes a tab shaped to extend over one of the edges of the belt. The tab includes a distal end adjacent the belt and visible but indistinguishable to a casual observer. The lower end is connected to the outer side intermediate the bottom and the top of the outer side such that when the sling is flexed outwardly away from the outer side, the wearer's shirt can be inserted therebetween to conceal the holster case.

In a further embodiment of the invention, I provide an improved holster system for concealment inside the trouser waistband of a wearer and suspended from the trouser waistband of the wearer at the inner side of the belt, the belt including an upper edge and a lower edge. The improved holster system includes a holster case defining a pistol storage compartment. The holster case includes an inner side; an outer elastically flexible side having a top and a bottom; a front; and, a back. The holster system also includes an elongate substantially rigid elastically flexible sling secured to the outer side whereby the elongate member and the outer side of the holster case can be partially separated so the wearer's shirt can be inserted therebetween to conceal the holster. The sling includes an upper end and a lower end. The upper end is reversibly bent to form a mounting tab shaped to extend over the trouser waistband; and, includes a tab shaped to extend over one of the edges of the belt. The tab includes an end. The lower end of the sling is positioned on the outer side intermediate the bottom and the top of the outer side such that when the sling is flexed outwardly away from the outer side the wearer's shirt can be inserted therebetween to conceal the holster case. The holster system includes at least one rivet extending through the lower end and the outer side affixing the lower end to the outer side.

In still a further embodiment of the invention, I provide an improved method for constructing a plurality of holster systems for concealment inside the trouser waistband of a wearer and suspended from the trouser waistband of the wearer at the inner side of the belt, the belt including upper and lower edges. Each of the holster systems includes a different sized holster case defining a pistol receiving compartment. The holster case has inner and outer opposite sides; a front; a back; a top; and, a bottom. The outer side has a top and a bottom. The method includes the step of providing a substantially rigid elastically flexible flex arm. The arm has an upper end reversibly bent to form a mounting tab shaped to extend over the trouser waistband and including a lock means shaped to extend over at least one of the edges of the belt; having a lower end; and, is shaped and dimensioned to mounted any one of the different sized holsters by securing the lower end to the outer side between the top and the bottom at a different distance from the bottom on each of the holster cases. The outer side of each holster case is elastically flexible. The method also includes the steps of selecting one of the holster case; selecting the distance from the bottom of the selected holster case to attach the lower end of the flex arm to the outer side of the selected holster case; selecting the orientation of the flex arm on the selected holster case; and, attaching the lower end of the flex arm to the selected holster case at a location that is the selected distance from the bottom of the selected holster; and, in the selected orientation.

Turning now the drawings, which depict the presently preferred embodiments of the invention for the purpose of illustration thereof, and not by way of limitation of the invention, and in which like characters refer to corresponding elements throughout the several views, FIG. 4 illustrates a holster system constructed in accordance with the invention and including a canted universal elastic polymer holster hanger with an indistinguishable belt lock and flex arm to conceal the holster case, to produce a shirt-engaging cam surface, and to produce a flexed gun securing surface.

The holster system includes a holster case defining a storage compartment for a holster or other item or items to be stored in the holster case. The holster case includes inner 32 and outer 31 opposing sides, front 33, back 34, top 35 and bottom 36. The outer side 31 is elastically flexible. Side 32 can also, if desired, be elastically flexible. As used herein, a component in the holster system of the invention is elastically flexible if displacement forces are applied to the component to bend it from its normal or original "at rest" state, and, when the component is bent, return forces are generated in the component which act to return elastically the component to the original "at rest" state configuration. The original "at rest" configuration is the configuration of the component prior to the component's being bent. When the displacement forces are released, the return forces cause the component to return elastically to its original "at rest" state configuration.

Elongate elastically flexible sling or hanger 40 includes upper end 41, lower end 42, and tab lock 44. Upper end 41 is reversibly bent or formed 65 to form a slot 66 that slidably receives the top of the waistband 75 of the users pants 72. Portions 45 and 46 of upper end 14 bracket opening 66. Apertures (not visible) are formed through lower end 42 and through outer side 31 to receive rivets 47 and 48. Sling 40 is normally canted away from side 31 such that opening 60 is formed intermediate sling 40 and side 31 to receive a portion of shirt tail 55 of the user's shirt 73. Tab lock 44 is shaped to extend over an edge 71 (or 72) of the user's belt 54. Lock 44 functions to lock the holster system of the invention in position inside the waistband of the user's pants because lock 44 contacts edge 71 and functions to prevent sling 40 and the attached holster case 30 from moving upwardly out of the waistband of the user's pants. In the event lock 44 extends over edge 72, lock 44 prevents sling 40 and holster case 30 from sliding downwardly and pulling against the waistband of the user's pants.

Lock 44 includes an indistinguishable or disguised distal end 80 that is positioned adjacent belt 54. As used herein, end 80 is indistinguishable if it will not normally be noticed by a casual observer. As used herein, end 80 is disguised if it is difficult for a person to see in daylight. End 80 is deemed to be normally not noticed if more than seventy-five percent of individuals do not notice end 80. A casual observer is a person who is talking to the user. A casual observer does not have the intention of physically searching the person of the user for guns or other weapons or articles. As can be seen in FIG. 3, end 80 is unusually small and would not normally be noticed by a casual observer and would be more difficult to see even though the observer can actually visually see end 80, i.e., even through the observer's eyes and brain see end 80, the observers brain keeps this information in the observer's sub-conscious and the user is not consciously aware of end 80. The width L of end 80 preferably is less than three-fourths of an inch, most preferably less than one-half inch. The height E (or D) of an end 80 is preferably less than three-quarters inch, most preferably less than one-quarter inch.

Another factor which affects whether end 80 is indistinguishable or disguised is the color of end 80. If end 80 is a dark color and belt 54 is a dark color, end 80 is indistinguishable. If end 80 is the same color as belt 54, it is more likely that end 80 is indistinguishable. If end 80 has a surface pattern (i.e., leopard spots) that matches a pattern on surface 81, it is more likely that end 80 is indistinguishable.

A further factor which can render end 80 indistinguishable or disguised is the position of end 80. When end 80 contacts or is adjacent belt 54 and/or edge 71 is it more difficult to see end 80. If end 80 is spaced away from belt 54 and/or edge 71, it is easier to see end 80, especially if the entire tab 44 lock becomes visible, or if the entire tab lock 44 becomes visible along with a portion of member 46.

Still another factor which determines whether end 80 is indistinguishable or disguised is whether end 80 extends over the exterior surface 81 of belt 54. If a tab end 80 includes an outwardly projecting finger 57 that extends over surface 81, then it is less likely that end 80 will be indistinguishable. The portion of finger 57 extending over surface 81 preferably has a height less than one-half inch, most preferably less than one-quarter inch, and has a width less than three-fourths of an inch, most preferably less than one-half inch.

As indicated by arrow F in FIG. 9, the upper end of elastically flexible universal sling 40 can be displaced away from side 31 in the direction of arrow F to facilitate inserting a portion 55 of the tail of the user's shirt in space 60.

FIGS. 11 and 12 illustrate the normal curvature in side 31 prior to installation of sling 40 on side 31. Lower portion 42 of sling 40 is substantially flat and includes straight edge 52. Straight edge 52 can, if desired, take on the shapes 50, 51 illustrated in FIGS. 5 and 6. Edge 52 can also, if desired, have a concave 83 or convex shape. Portion 42 can be concave or convex instead of flat.

When lower portion 42 is riveted to side 31, portion 42 functions to flatten out the normal curvature of side 31 in the direction of arrow H (FIG. 11) in the manner illustrated in FIGS. 11A, and 12A. This flattening of side 31 imparts an inward curvature 63 to side 31. Inward curvature 63 reduces the volume of the gun storing compartment inside holster case 30 and tends to more tightly secure a gun in the holster case 30.

The inward curvature 63 also functions to alter the curvature of the outer surface 90 and displaces the portion of surface 90 immediately above rivets 47 and 48 outwardly toward and against lower portion 42 in the direction of arrow G (FIG. 11), forming a cam surface 91 on surface 90. The cam surface alters the direction of travel of the users shirt tail inwardly toward the inside of holster case 30, which more securely holds the shirt tail intermediate portion 42 and surface 90.

When upper portion 41 is elastically flexed in the direction of arrow F, the inward curvature 63 is accentuated and increased in the direction of arrow H (FIG. 10) and the outward curvature of cam surface 91 is increased in the direction of arrow G (FIG. 10), which tends to more tightly compress and secure a gun in the holster case while a portion of the user's shirt tail is inserted intermediate sling 40 and side 31 and tends to better secure a portion of the users shirt tail intermediate side 31 and lower portion 42.

Sling 40 can be shaped and dimensioned such that when lower portion 42 is attached to side 31, edge 52 is positioned at the lower edge 92 on the bottom 36 of holster case 31. This is not, however, preferred in the practice of the invention because curvature 63 is less likely to be produced, or if it is produced, it is less likely to more tightly secure a handgun in the holster case because curvature 63 would be at the bottom of the holster case. Positioning edge 52 at the lower edge 92 also is not preferred because it would make it more difficult for sling 40 to be utilized on a variety of different sized holsters. Accordingly, it is preferred to secure lower portion 42 on side 31 intermediate the top 35 and bottom 36 of holster case 30.

Sling 40 can be fabricated from any desired material, but is presently preferably molded from plastic to produce a hard, water-proof, elastically resilient, substantially rigid sling 40.

The inner end of each rivet 47, 48 is in an opening 53 countersunk on the inside of side 31 so that the inner end does not extend outwardly into the gun storage compartment of holster case 30.

While any means can be utilized to secure lower portion 42 to the side 31 of a holster case 30, means are presently preferred which do not require modification of sling 40 in order to attach sling 40 to different sized holster cases or to holster cases which are of equal size but are positioned differently with respect to and in the waistband of a user. Consequently, portion 42 is presently provided with one or more apertures to facilitate riveting portion 42 to the side 31 of a holster. Openings or apertures can be formed through portion 42 for stitching portion 42 to a side 31. Any other desired means can be utilized to secure portion 42 to a side 31 of a holster case 30.

After portion 42 is secured to a side 31 the top of bend or elbow 65 of sling 40 is positioned within an inch, preferably within a half inch, of the upper edge or lip 84 of case 30, i.e., the top of elbow 65 can be one inch above or one inch below lip 84.

The length, indicated by arrows A, of sling 40 permits sling 40 to be mounted on a wide variety of different sized holsters such that portion 42 is attached to a side 31 at a location intermediate the top 35 and bottom 36 of the holster and such that the top of elbow 65 is positioned within one inch of edge 84. While the length A can vary as desired, the length A of sling 40 is presently about three and three-fourths inches. The width of bend 65 is presently about three-quarters inch, is in the range of one-quarter inch to two inches, and is preferably in the range of one-half inch to three-quarters inch.

One advantage of sling 40 is that it can be attached to various sizes or kinds of holsters without requiring that the shape and dimension of sling 40 be altered. Sling 40 is universal.

Another advantage of sling 40 is that it can be attached to various sizes or kinds of holsters without requiring that the process for manufacturing the original holster be changed. Once the location of portion 42 on a holster is determined, a pair of rivet holes can be formed through a side of the holster to attach portion 42 to the holster.

A further advantage of sling 40 is that it is readily secured to a holster in a variety of orientations. One orientation of sling 40 is shown in FIG. 4. Another orientation, indicated by dashed lines 40A, is obtained by canting sling 40 in the direction indicated by arrow P before portion 42 is riveted or otherwise secured in fixed position to side 31. Still another possible orientation, indicated by dashed lines 40B, is obtained by canting sling 40 in the direction indicated by arrow Q before portion 42 is riveted or otherwise secured to side 31. Canting sling 40 on case 30 alters the position occupied by case 30 when it is inserted inside the waistband 75 of a user's pants 72. Canting sling 40 on case 30 does not alter the position and orientation of sling 40 on a user's waistband 75 when the holster system is installed.

In use, a plurality of holster slings 40 are provided. A plurality of different sized holster cases are provided. Each holster case has a different length from top 35 to bottom 36. The position of the top of bend 65 with respect to the top edge 84 of each holster case is determine. For sake of this discussion, it is assumed that the top of bend 65 is to be even with edge 84 on each holster case. The cant of a sling 40 on each holster case is determined. On one holster case, sling 40 is not canted and is in the "straight up" position illustrated in FIG. 4. On another holster case, sling 40 is canted rearwardly to the position indicated in FIG. 4 by dashed lines 40A. On still another holster, sling 40 is canted forwardly to the position indicated in FIG. 4 by dashed lines 40B. Once the orientation of a sling 40 on each holster case is determined, the portion 42 of each sling is secured to a side of the holster case. If portion 42 of each sling 40 is attached with rivets, openings are formed in a side 31 of the holster case and portion 42 is riveted to a side 31 of the holster case 30. Once a sling 40 is secured to a holster case 30, the holster system is completed. A user installs a holster system on his or her waistband 75 by sliding the upper portion 41 over the top of waistband 75 such that a portion of waistband slides upwardly into opening 60 and such that tab 44 is positioned beneath edge 71 in the manner illustrated in FIGS. 3 and 8. The user manually displaces the upper portion 41 of sling 40 away from side 31 in the direction of arrow F in FIG. 9 and slides a portion 55 of his shirt tail intermediate side 31 and member 45 to the position illustrated in FIG. 8. Displacing portion 41 in the direction of arrow F causes the portion of wall 31 adjacent edge 52 to be further displaced in the direction of arrow H, to increase the curvature 63, and to reduce the space inside case 30 to more securely maintain a handgun or other item in case 30. Displacing portion 41 in the direction of arrow F also accentuates the curvature of cam surface 90 to force surface 90 toward portion 42 and to more securely maintain a portion of shirt tail 55 between cam surface 90 and portion 42. The user then releases portion 41. Flexible resilient sling 40 returns to the normal unflexed position illustrated in FIG. 8; provided, however, pressure generated by the users body against case 30 may function to squeeze sling 40 against side 31. Member 46 is positioned behind belt 54 in the manner indicated in FIGS. 8 and 3 such that, as earlier noted, tab 44 is positioned directly beneath edge 71. The user "blouses" his shirty by slightly pulling his shirt upwardly out from waistband 75. The bloused shirt conceals the top of bend 65 in the manner illustrated in FIG. 3 so that the only visible portion of the holster assembly of the invention is distal end 80. As can be seen in FIG. 3, the "visual signature" of distal end 80 is small and, consequently, even though an individual viewing the waist of the user can see end 80, the individual's brain typically discounts and does not consciously see and/or recognize end 80.

EXAMPLE 1

A user, a thirty-five year old male, mounts the holster assembly of the invention, including handgun 74 inserted in holster case 30, on his waistband in the manner illustrated in FIG. 3. The distal end is five-sixteenths of an inch wide and one-quarter inch high and is black. The user approaches at a picnic sixteen (16) other adults and has casual conversations with each. During the conversations end 80 is visible and can be seen by each of the adults. During the conversations, none of the adults asks about distal end 80; none of the adults ask the user if he is wearing a concealed weapon; and, none of the adults appear to notice end 80. After the picnic, the user approaches each of the sixteen adults and asks if they had noticed end 80. Each adult states that they had not seen end 80. The user also asks if the sixteen individuals were aware the user was wearing a concealed weapon. Each of the individuals says he or she was not aware the user was wearing a concealed weapon.

EXAMPLE 2

Example 1 is repeated except the distal end 80 is three-quarters of an inch wide and one-half inch high. Similar results are obtained.

EXAMPLE 3

Example 1 is repeated except that distal end 80 includes an upstanding lip 57 that extends upwardly over a portion of the face 81 of the user's belt 54. Similar results are obtained.

EXAMPLE 4

Example 3 is repeated except that the distal end 80 is one inch wide and one inch high. Some of the individuals notice end 80 while having casual conversations with the user.

One disadvantage of the sling 40 is that it is attached to the side of a holster. The side of the holster typically is perforated by rivets used to secure the sling 40 in place. In addition, the sling 40 can only be installed on one side of a holster. Removing the sling 40 from a holster to install it on the opposite side of the holster is difficult (because rivets have to be removed) and impractical, and exposes damaged areas on the side of the holster. These problems are remedied by the holster 130 and sling 140 illustrated in FIGS. 13 to 15. Sling 140 is used to conceal holster 130 in the same general manner than sling 40 is used to conceal holster case 30.

Holster 130 includes inner side 132, outer side 131 opposing side 132, front 133, back 134, top 135, and bottom 36. Flange 137 is connected to and extends outwardly from front 133. Flange 137 includes upper portion 104A and lower portion 104B. Aperture 105 is formed in lower portion 104B. Aperture 106 is formed in lower portion 104B. Apertures 105, 106 can extend partially or completely through flange 104B. Sides 131 and 132 co-terminate at front 133 and back 134. Flange 137 presently is a laminate consisting in part of an extension of the leather or polymer or other material comprising side 132 and in part of an extension of the leather or polymer or other material comprising side 131. The construction of flange 137 can vary as desired.

In FIG. 15, elongate elastically flexible sling or hanger 140 includes upper end 141 and lower end 142. Upper end 141 includes fingers 144A to 144B that each form a slot that slidably captures an edge of a belt 54 (FIG. 15). Fingers 144B and 144C are spaced apart from and opposed to finger 144B. When lower end 142 is secured to the lower portion 104B of flange 137 in the manner illustrated in FIG. 15, upper end 141 can be elastically flexed away from side 131 in the direction of arrow F2 in the same manner that sling 40 can be flexed away from the side of a holster in the direction of arrow F as illustrated in FIG. 9. The flexing of end 141 in the direction of arrow F facilitates tucking the user's shirt intermediate holster 130 and the upper end 141 of hanger 140.

Upper end 141 is formed to form a slot 66 that slidably receives the top of the waistband 75 of the user's pants 72. Portions 145 and 146 of upper end 141 bracket or bound slot 66. When the user's belt slidably extend through fingers 144A to 144C, and when the waistband 75 of the user's pants are in slot 166, portion 146 and lower end 142 extend inside the user's pants to support holster 130 inside the user's pants in the same manner that holster 30 is supported inside the user's pants in FIG. 3.

Aperture 100 is formed through lower end 142. Pin 101 depends and extends outwardly from end 142. In FIG. 15, pin 101 is not visible but is seated in aperture 105 formed in flange 137. Pin 101, when seated in aperture 105, prevents sling 141 from pivoting about fastener 145. Fastener 145 includes screw head 145 and includes externally threaded leg (not visible) that extends through aperture 100 and turns into internally threaded aperture 106 to affix lower end 142 to the lower end 104B of flange 137.

Intermediate portion 102 of sling 140 bends to contour around the front of holster 130. When installed on holster 130, sling 140 is canted, or angled, across a side of the holster.

One important advantage of the holster 130 and sling 140 of the invention is that sling 140 can be readily mounted on either side of holster 130 to adapt the holster for a right handed or left handed user, as the case may be. Apertures 105 and 106 preferably, but not necessarily, extend completely through flange 137 so that when fastener 145 is removed, when sling 140 is moved from the position shown in FIG. 15 in which sling 140 is positioned at an angle across outer side 131, when sling 140 is moved to a position angled across opposing side 132, and when lower end 142 is positioned adjacent the back side 104C (FIG. 15) of the lower portion 104B of flange 137, pin 101 seats in aperture 105 and the externally threaded body of fastener can be slid through aperture 100 and turned into internally threaded aperture 106. If apertures 105 and 106 do not extend completely through flange 137, then similar apertures are formed in the back side 104C of the lower portion 104 of flange 137 to receive pin 101 and fastener 145. When 140 is positioned over the outer surface of opposing side 132 with lower end 142 secured to back side 104C, the holster 130 and sling 140 can be utilized by a left handed user.

Having described the presently preferred embodiments and best mode of the invention in such terms as to enable those of skill in the art to understand and practice the invention

I claim:

1. A holster system for concealment inside the trouser waistband of a wearer and suspended from the trouser waistband of the wearer at the inner side of the belt, the belt including an upper edge and a lower edge, the holster system including (a) a holster case defining a pistol storage compartment, said holster case having
  (i) a front,
  (ii) a back,
  (iii) a top,
  (iv) a bottom,
  (v) a pair of sides coterminating at said front and back,
  (vi) a flange extending outwardly from said front;

(b) an anchor aperture formed in said flange;

(c) an elongate substantially rigid elastically flexible sling secured to flange and extending over one of said sides, whereby the elongate member and the outer side of the holster case can be partially separated so the wearer's shirt can be inserted therebetween to conceal the holster, said sling including
  (i) an upper end
    formed to extend over the trouser waistband, and
    including a plurality of opposed fingers each shaped to extend over one of the edges of the belt, and
  (ii) a lower end connected to said flange and including
    an anchor member attached to said lower end and extending into
    said anchor aperture to prevent said sling from pivoting on said holster case, and
    a fastener securing said lower end to said flange.

* * * * *